United States Patent [19]

Phillips, Jr. et al.

[11] Patent Number: 4,742,580

[45] Date of Patent: May 10, 1988

[54] COLD WEATHER HAND PROTECTING EQUIPMENT

[75] Inventors: James G. Phillips, Jr., Pleasant Grove; Joanne Harlow, Orem, both of Utah

[73] Assignee: Burlington Industries, Inc., Greensboro, N.C.

[21] Appl. No.: 58,891

[22] Filed: Jun. 5, 1987

[51] Int. Cl.[4] ..... A41D 19/00

[52] U.S. Cl. ..... 2/158; 2/164

[58] Field of Search ..... 2/158, 159, 161 R, 169, 2/164, 125

[56] References Cited

U.S. PATENT DOCUMENTS

| | | | |
|---|---|---|---|
| 2,274,335 | 2/1942 | Kennedy | 2/158 |
| 3,299,441 | 1/1967 | Slimovitz | 2/158 |
| 3,403,408 | 10/1968 | Helfer | 2/158 |

*Primary Examiner*—Louis K. Rimrodt
*Assistant Examiner*—Judith L. Olds
*Attorney, Agent, or Firm*—Nixon & Vanderhye

[57] ABSTRACT

A thin fabric wind resistant mitten, made primarily of a fabric having an air permeability of less than 15 cubic feet per minute per square foot at 0.5 inches head of water, and preferably having a wear resistant palm portion and an extendable trigger finger, may be used over or in place of anti-contact gloves. The wind resistant mitten may store in a pocket formed on the outside surface of a cold weather mitten. The cold weather mitten has inner and outer synthetic material fabrics, and an open cell foam at least about ⅛ inch thick (e.g. ½–1 inch thick) between the fabrics. The size of the access opening to the cold weather mitt is easily changed, it has a curvature corresponding to the curvature of a normal human hand at rest, and a lanyard attached to the outer fabric is connected to the wind mitt, storable in the outer pocket. A suspension system comprising barrel locks and suspension cords readily adjustably supports the cold weather mitts on a wearer's neck.

34 Claims, 5 Drawing Sheets

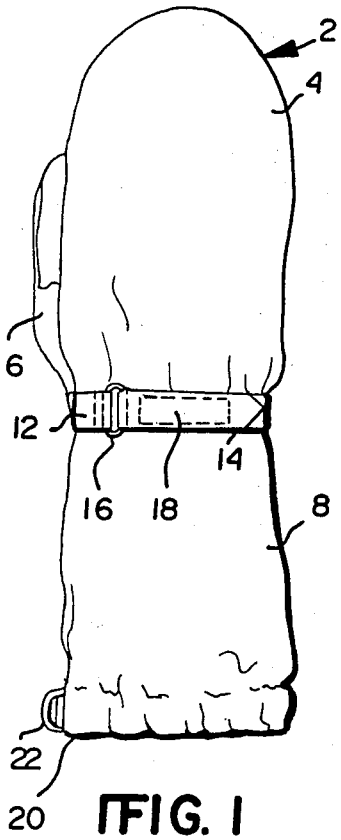
FIG. 1
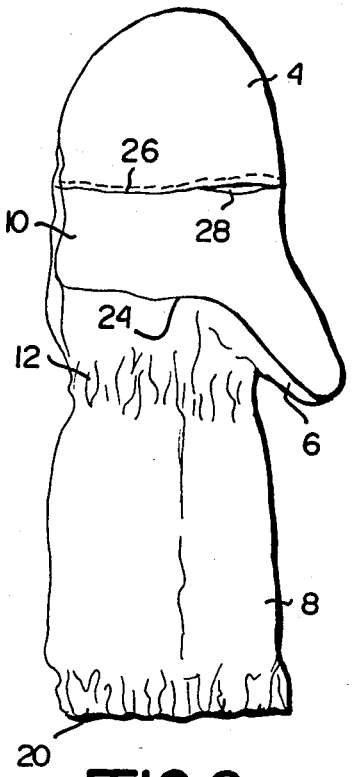
FIG. 2
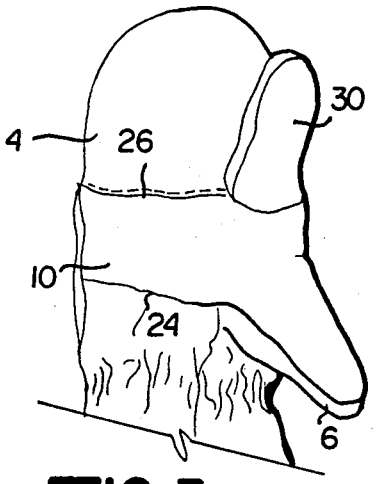
FIG. 3
FIG. 4
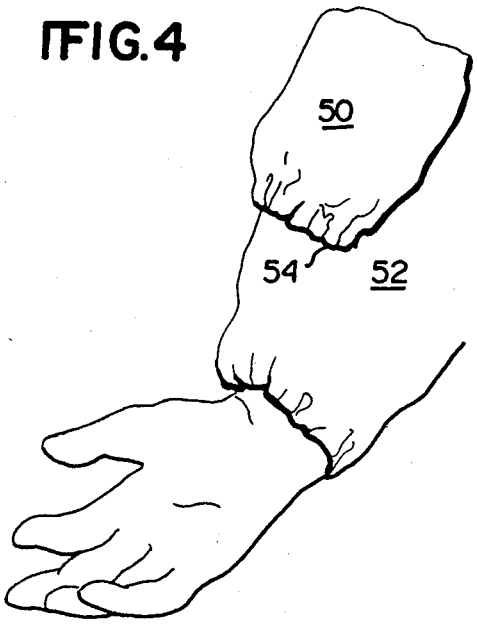
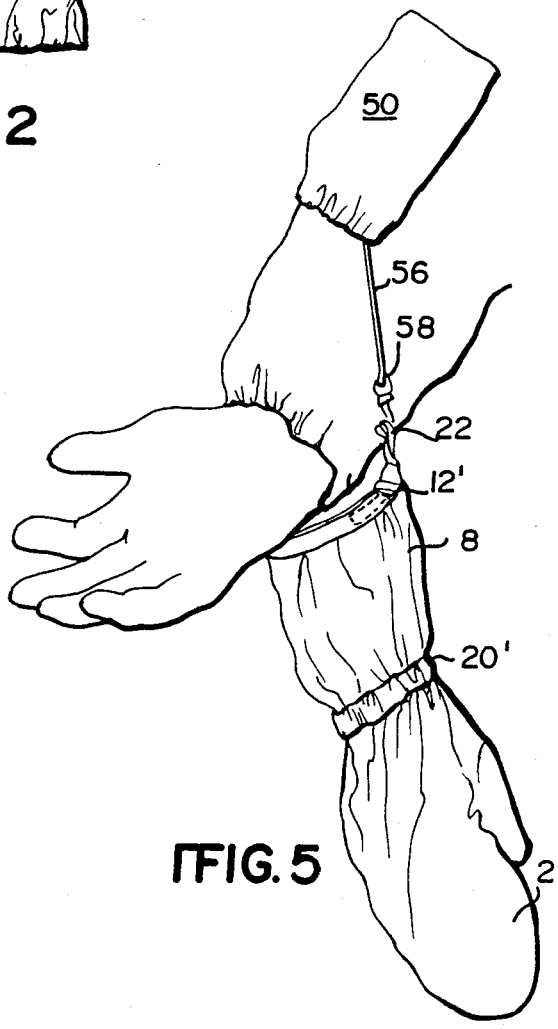
FIG. 5

COLD WEATHER HAND PROTECTING EQUIPMENT

BACKGROUND AND SUMMARY OF THE INVENTION

The invention relates to equipment for protecting a human's hands from the elements in a wide variety of temperature conditions, including very low temperature conditions and high wind conditions. The invention also relates to the individual component parts of the system, particularly a wind resistant mitten formed of thin fabric primarily of a low porosity, wind resistant material (i.e. having an air permeability of less than about 15 cubic feet per minute per square foot at 0.5 inches head of water); a cold weather mitten which may be used in conjunction with a wind resistant mitten, or by itself; and a suspension system for suspending cold weather mittens, when not in use, from a wearer's neck.

In many cold weather environments, it is necessary for a human performing work in the environment to have manual dexterity while still protecting his hands from the cold, and particularly from contact with metallic objects, or other objects which might cause severe injury if touched by bare skin. Typically anti-contact gloves, such as those made of 100 percent polypropylene or 100 percent polyamide (nylon) are utilized. However in high wind, or like conditions, the anti-contact gloves provide insufficient protection to the wearer's hands, and the wearer cannot perform tasks requiring manual dexterity in exposed areas.

According to one aspect of the present invention, sufficient manual dexterity can be achieved, while at the same time providing increased protection from the wind and cold, by the utilization of a mitten made of a thin, wind resistant fabric. The wind resistant mitten is preferably made of a fabric which has an air permeability of less than 15 cubic feet per minute per square foot at 0.5 inches head of water, while having a moisture vapor transport (MVT) rate of greater than about 500 grams per square meter per 24 hours (and typically greater than 1,000 grams per square meter per 24 hours). The wind resistant mitten also may have a palm portion of a durable, wear resistant fabric which is joined to the wind resistant fabric making up the majority of the mitten. Such a mitten, when placed over anti-contact gloves, greatly extends the lower temperature range at which the wearer can effectively function. While greatly extending the effective temperature range, the mitten does not significantly adversely affect dexterity, so that many tasks requiring significant manual dexterity may still be performed. The wind resistant mitten specifically has a deployable trigger finger, which allows the user to handle a gun and perform like tasks.

When extremely cold weather conditions are confronted, it is necessary for additional cold weather protection to be provided. According to the present invention a cold weather mitten also is provided which is designed to be used in conjunction with the anti-contact gloves and wind resistant mitten (or by itself) to provide protection against extremely low temperatures. The cold weather mitten according to the invention comprises an outer synthetic material shell fabric, an inner synthetic material lining fabric, and a layer of open cell foam between the inner and outer fabrics, the foam layer being at least about ⅛ inch thick (and preferably at least about ¼ inch thick, desirably about ½ to 1 inch thick) over a majority of the mitten. The thickness of the foam will depend on the foam's insulative properties and the construction of the shell and liner fabrics. Any thickness of foam that, cooperating with the shell and lining fabrics, provides cold weather protection at temperatures well below 0° F. is appropriate.

At the open end of the mitten, fastening means are provided for effectively changing the size of the opening at the open end. When the fastening means are disconnected easy entry of a wearer's arm and hand into the mitten is facilitated, while when the fasteners are connected the mitten fits tighter at the wearer's forearm to provide better cold weather protection. This adjustability also allows the mittens to accommodate varying thicknesses of garments that the user may wear. Each cold weather mitten has an inward curvature at the hand portion thereof so that the mitten is in the configuration of a wearer's hand when at rest, for greater comfort and so that there is less fatigue.

On the back side of the mitten, a pocket is provided which is dimensioned so that the wind resistant mitten (when folded or otherwise disposed in a low volume configuration) may fit therein, and/or the anti-contact glove may fit therein. A lanyard is preferably provided connected to the cold weather mitten, at one end thereof, within the pocket, and extendable out of the pocket and connectable to the wind resistant mitten at the end thereof exterior of the pocket.

A suspension mechanism is provided for suspending the cold weather mittens, when not in use, from the wearer's neck. The suspension mechanism comprises an assembly of cords and barrel locks which allow the suspension mechanism to be easily removed from the wearer's neck, or moved into a position in which the cold weather mittens are tightly held at the wearer's neck. The cords cooperate with attachment means located on the mittens further from the open ends of the mittens than the center of gravity of the mittens so that the mittens, when suspended by the suspension mechanism, hang with the openings facing substantially downwardly.

It is the primary object of the present invention to provide effective cold weather protection, over a wide variety of conditions and circumstances, for a human's hands. This and other objects of the invention will become clear from an inspection of the detailed description of the invention, and from the appended claims.

BRIEF DESCRIPTION OF THE DRAWINGS

FIG. 1 is an elevation of the back side of a wind resistant mitten constructed in accordance with an exemplary embodiment of this invention;

FIG. 2 is an elevation of the palm side of the mitten illustrated in FIG. 1 with an optionally deployable third finger portion hidden from view within the mitten;

FIG. 3 is an elevation of the palm side of the mitten as in FIG. 2 but wherein the third finger enclosing portion is shown in a deployed position outside the main body portion of the mitten;

FIG. 4 is a perspective view of a forearm portion of a sleeve of a jacket which may be utilized in combination with the mitten of this invention, and wherein the jacket sleeve is provided with a pocket for storing the mitten;

FIG. 5 is a view similar to that in FIG. 4, but wherein the mitten is modified, and is deployable but connected to the storage pocket on the jacket sleeve;

DETAILED DESCRIPTION OF THE INVENTION

Figure 7:
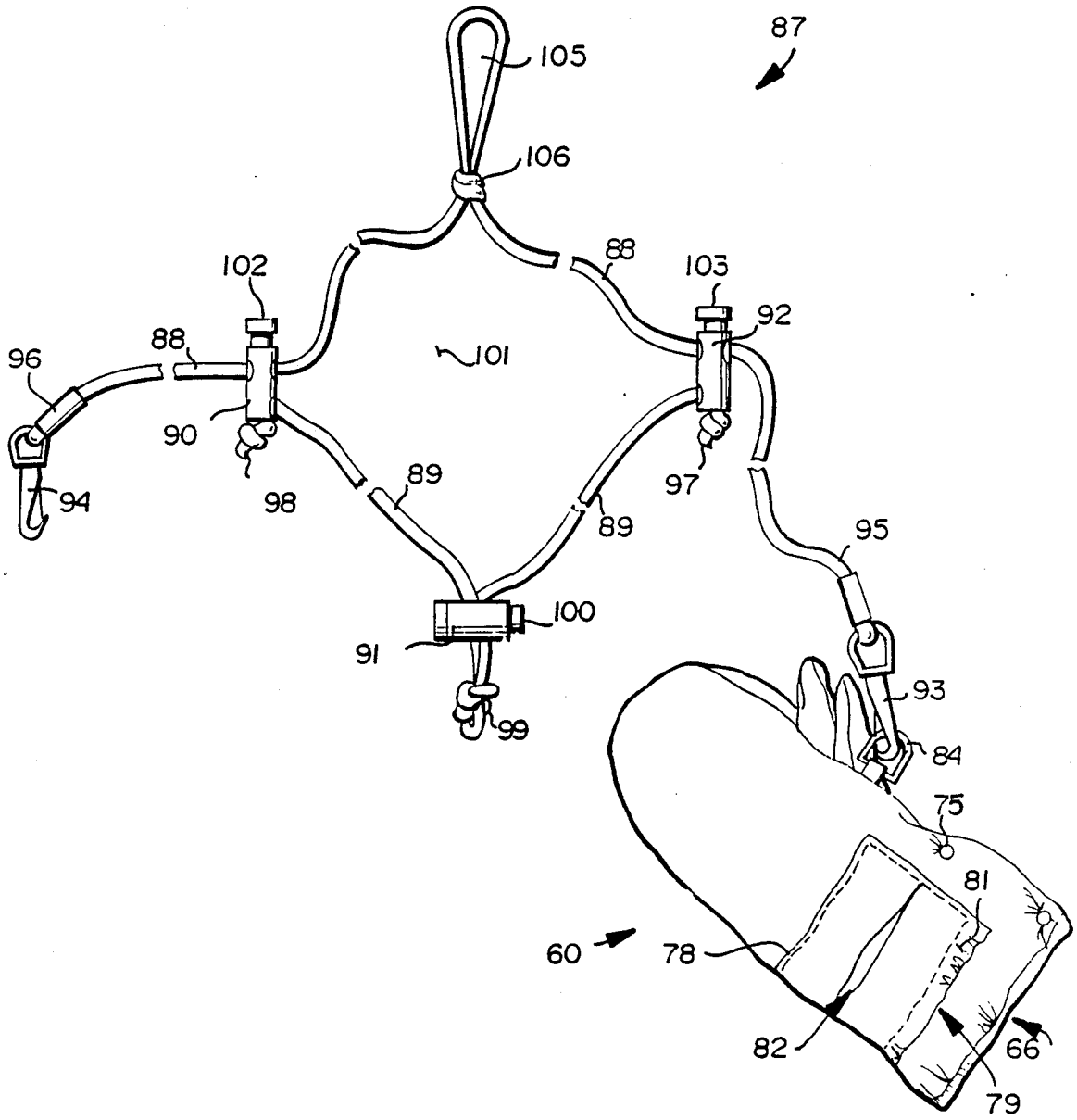
FIG. 7 is a schematic showing of a suspension mechanism, in conjunction with a mitten, for suspending the cold weather mittens from a wearer's neck, when not in use.

FIGS. 1 and 2 illustrate a wind-resistant "three finger mitten" in accordance with this invention. The mitten 2 is formed with a main portion 4 for normally enclosing four fingers of a wearer's hand, and a thumb enclosing portion 6. Integrally formed with the body and thumb portions, is a rearwardly extending gauntlet portion 8 which encloses the wrist and part of the forearm.

The above described portions of the mitten 2 are preferably formed of a durable, low porosity, wind resistant thin fabric. One suitable fabric is Verstech TM but other fabrics having similar characteristics may also be utilized. The fabric has an air permeability of less than 15 $ft.^3/min./ft.^2$ at 0.5 inches head of water, and preferably a moisture vapor transport (MVT) rate of at least 500 $grams/m.^2/24$ hours, and typically an MVT of greater than 1000.

As best seen in FIG. 2, a palm covering portion 10 is provided which is formed of a different fabric, preferably a durable, water repellent and wear resistant fabric having low air porosity and good grip characteristics. Depending on the particular environment in which the mitten is to be utilized, it will be appreciated that the palm portion 10 may be heat resistant as well.

The palm portion 10 preferably extends across the interior surface of the thumb portion, but may terminate short of the thumb portion if so desired.

Encircling the mitten at a location intermediate the hand and the gauntlet portions, i.e., at a point generally coincident with the wrist, is an adjustable strap 12, a free end 14 of which may be looped through a ring 16 attached to the other free end of the strap, doubled back on itself, and fastened with a hook and loop material 18. Material 18 is preferably of the type commonly marketed under the trade name Velcro TM but it will be appreciated that any conventional fastening arrangement may be employed.

An elastic strap 20 is enclosed within the rearward edge of the gauntlet portion 8. It will be understood that the adjustable strap 12 and elastic strap 20 serve to securely hold the mitten on the hand, and that strap 12 can be tightened as desired.

In the FIG. 5 embodiment, an elastic band 20' is provided at a point coincident with the wrist, while a strap arrangement 12', with hook and loop fasteners, is provided at the rearward edge of the gauntlet portion.

The palm portion 10 is sewn into the body portion 4 of the mitten along seams 24 and 26. A third finger enclosing portion 30, formed with the same wind resistant fabric as the hand enclosing and gauntlet portions, is provided in the mitten, and extends from the seam 26 at a point opposite the thumb portion 6. This third finger portion, best seen in FIG. 3, corresponds to the wearer's index finger.

Referring back to FIG. 2, a slit 28 is provided along the seam 26 for receiving the third finger portion in a hidden or stored position within the interior of the mitten. It will be understood that when the index finger portion 30 is within the mitten, it may or may not be used by the wearer of the mitten. In any event, in the stored position, the portion 30 extend generally parallel to the index finger so that it may be easily accessed as desired. FIG. 3 illustrates the finger portion 30 in a deployed position which provides the wearer with increased dexterity for performing certain tasks. For example, such tasks as picking up small items, manipulating any of a wide variety of control devices, firing weapons, and so on, particularly in sub-zero temperatures, are easily carried out with the mitten constructed according to this invention. At the same time, the index finger is afforded the protection of the wind resistant material forming the portion 30 of the mitten.

In FIG. 4, a mitten in accordance with this invention is shown stored within a pocket 50 formed in the sleeve 52 of a cold weather jacket. An elastic band may be utilized at the open end 54 of the pocket to prevent the mitten from sliding out of the pocket.

In FIG. 5, the modified mitten is shown removed from the pocket, but nevertheless connected thereto by an elastic strap, or a cord, 56 provided with an openable hook 58 or other suitable attachment means which may be connected to the D-ring 22. It will be understood that the band 56 may be stretched to permit the wearer to insert a hand in the mitten, and that the strap or band 56 may be tucked out of the way in the pocket 50 once the hand is fully inserted within the mitten.

Figure 6:
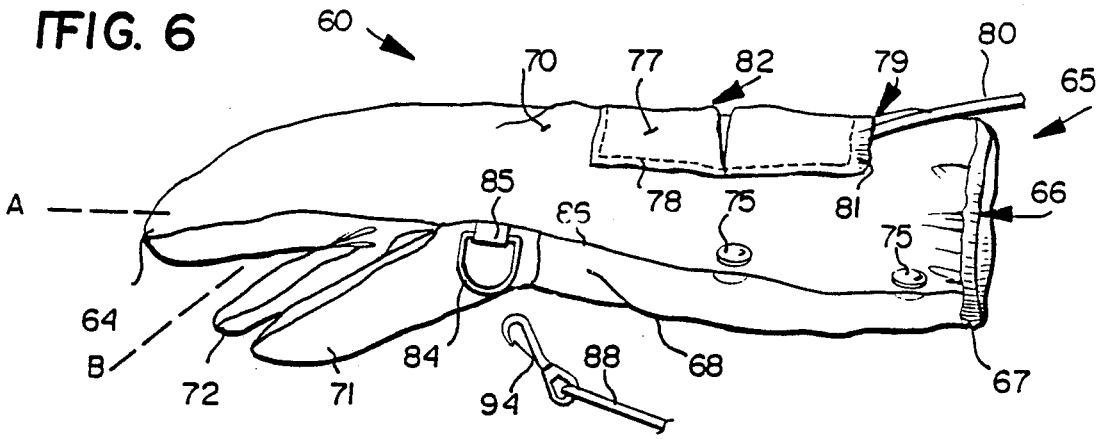
FIG. 6 is a top view of an exemplary cold weather mitten according to the invention when in a normal use position.
Figure 8:
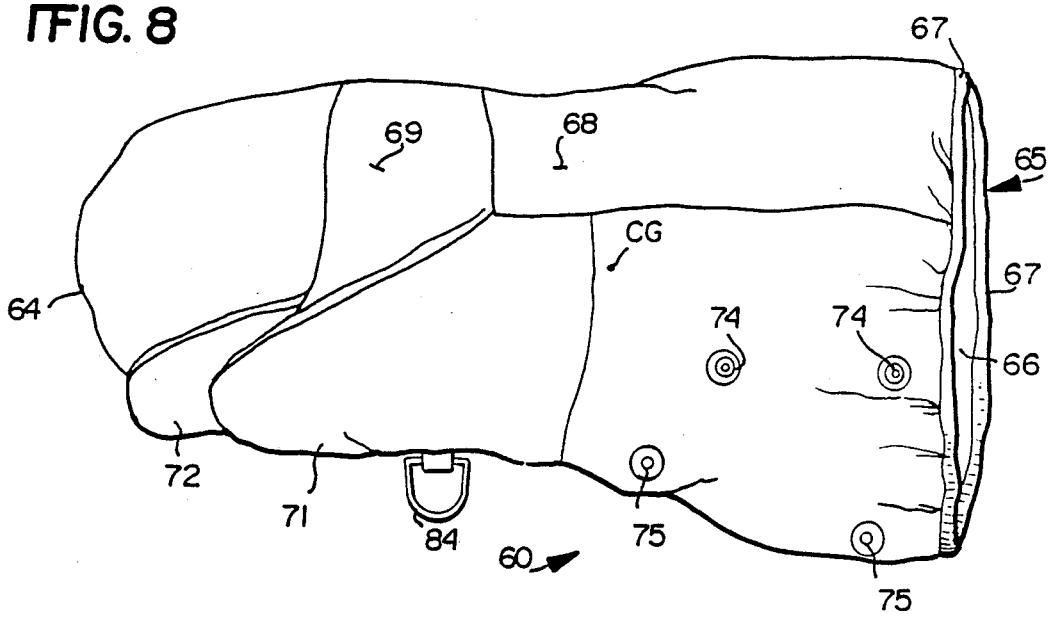
FIG. 8 is a plan view of the inside face of the cold weather mitten of FIG. 6.
Figure 9:
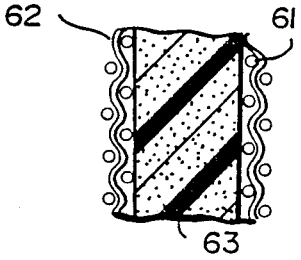
FIG. 9 is a schematic cross-sectional view of a portion of the mitten of FIG. 6.

A cold weather mitten according to the invention is illustrated generally at reference numeral 60 in FIGS. 6 through 8. The cold weather mitten 60 has a portion thereof shown in cross-section in FIG. 9, and includes a synthetic material inner lining fabric 61, an outer synthetic material shell fabric 62, and a layer of open cell foam (e.g. polyurethane foam) 63 between the fabric 61, 62. The foam 63 may be a skinned foam as disclosed in co-pending application Ser. No. 31,661 filed Mar. 30, 1987.

The lining fabric 61 preferably comprises 100 percent nylon tricot jersey fabric, but a wide variety of other fabrics are also useful as long as they do not significantly adversely affect the MVT rate of the mittens. The shell fabric 62 may be 100 percent woven nylon, and treated with a water repellent material such as "SCOTCHCARD", commercially available from 3M Company of Minneapolis, Minn. The shell fabric 62 may be of the same construction as presently commercially available military nylon, or where the cold weather mitten 60 is to be utilized individually and enhanced wind resistance is desirable, it can be made of a low porosity wind resistant fabric such as "VERSATECH" available from Burlington Industries, Inc. of Greensboro, N.C., or a tightly knit nylon fabric made of commercially available approximately 210 denier continuous filament nylon warp yarn and a 3 ply approximately 70 denier air-textured nylon filling yarn, woven in a plain weave having about 79 ends and about 61 picks per inch.

The foam layer 63 is at least about ⅛ inch thick over a majority, if not all, of the mitten. The foam thickness will depend upon its insulative properties and the properties of the shell and lining fabrics, all of which cooperate to provide cold weather protection. For most shell and lining fabrics, a foam thickness of at least about ¼ inch (e.g. ½–1 inch) is necessary to provide good protection to well below 0° F.

The mitten has a closed finger receiving end 64, and an open end 65 defining an opening 66 for insertion of the wearer's hand for positioning within the mitten. Preferably rib trim 67 is provided around the opening 66, the rib trim being 100 percent polyester knit. The mitten also includes an inside face 68, including a palm portion 69, an outside face 70 opposite the inside face 68, a thumb portion 71, and a "third finger" or trigger finger portion 72 disposed between a thumb portion 71 and the inside face 68.

Figure 11:
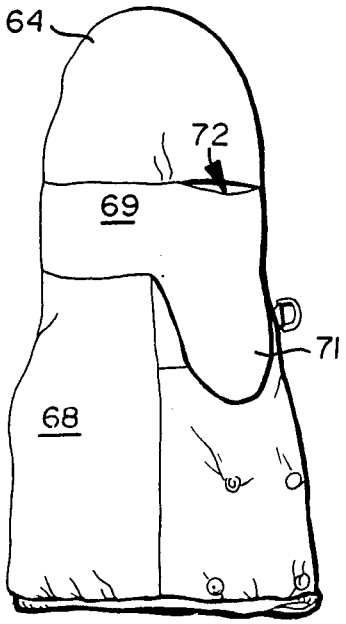
FIG. 11 is a side view of the mitten of FIGS. 7 and 8 with the "third finger" thereof stowed.
Figure 12:
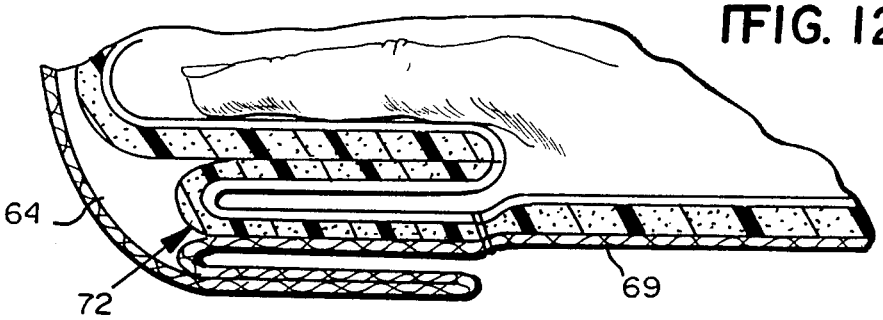
FIG. 12 is a cross-sectional view of the portion of the mitten of FIG. 11 with the third finger stowed.
Figure 13:
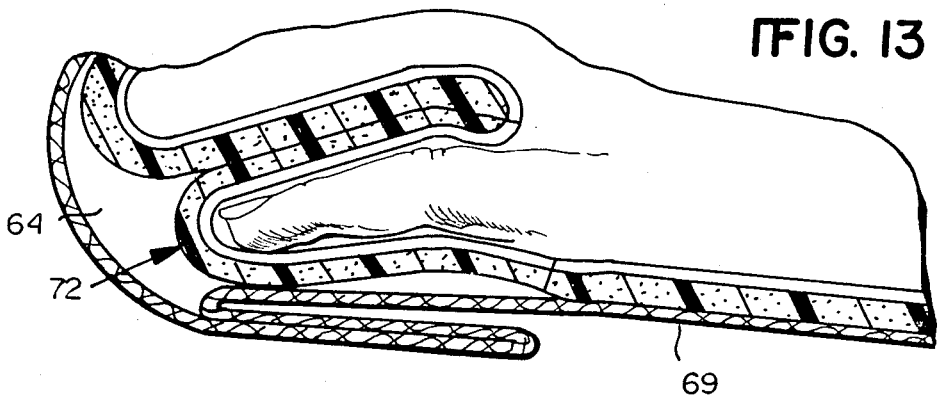
FIG. 13 is a cross-sectional view like that of FIG. 12 only showing the wearer's index finger in a different position.
Figure 14:
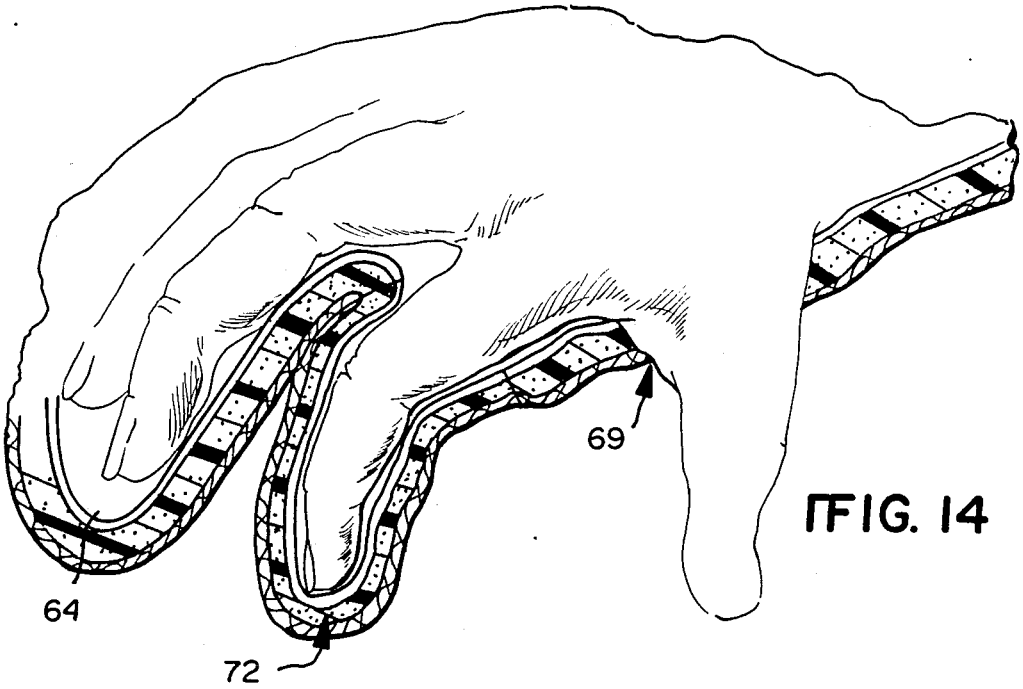
FIG. 14 is a cross-sectional view like that of FIG. 12 only showing the index finger inserted into the deployed third finger.

The third third finger 72 and palm area 69 are so constructed that the third finger can be tucked inside the mitten palm fabric and lay flat extending forward between the outer fabric and the foam insulation. See FIGS. 11–14. The third finger so stowed offers three distinct advantages. First, it is out of the way and protected when not in use, but it can be quickly and easily deployed for use. See FIG. 11. Second, with it stowed there is a "thick spot" of extra insulation over the index finger (see FIG. 12). As the wearer grips a cold object this thick area provides extra thermal protection in the primary grip area between the thumb and index finger. Third, the wearer can insert this index finger into the stowed third finger. Used in this manner the index finger will be in a "thin spot" inside the mitten. This "thin spot" will give the user a better "feel" while still keeping the index finger inside the mitten (see FIG. 13).

One significant feature of the cold weather mitten according to the invention is the ability to adjust the mitten so that a wearer may easily insert his/her hand and arm into the mitten, while still allowing the mitten to be tightly conformed around the wearer's forearm to minimize heat leakage, and the like. This is accomplished according to the invention by providing fastening means adjacent the open end 65 for effectively changing the size of the opening 66. The fastening means in the exemplary embodiment illustrated in FIGS. 6 and 8 includes first and second male snap fasteners 74, adapted to cooperate with first and second female snap fasteners 75. With the snap fasteners 74, 75 in the position illustrated in FIG. 8, the opening 66 is relatively large, and it is easy for a wearer to insert his/her arm with large thick garments on into the opening 66. Alternatively, before the wearer's hand is inserted, the snap fasteners 74, 75 can be moved into operative relationship with each other as illustrated in FIG. 6, in which case the opening 66 is significantly reduced in size, causing the mitten 60 to fit snugly around the wearer's forearm when thinner garments are being worn. The adjustability allows the use of these mittens with thin or thick garments yet still provides a good seal between the mittens and the garment sleeve.

Another feature of cold weather mitten 60 is the provision of a pocket 77 on the outer face 70 of the mitten 60. The pocket 77 preferably is constructed so that it is stitched—as indicated schematically at 78 in FIGS. 6 and 7—along three sides thereof to the outer surface 70 of the mitten, and has an open end 79 adjacent the mitten open end 65. A lanyard 80 preferably is connected at one end thereof to the mitten interiorly of the pocket (as to a strap sewn to the mitten), the lanyard extendable to a position outward of the mitten and has a clip at the free end thereof which clips to D-ring on the wearer's skirt, jacket, pants sleeve, or cord 80. The pocket preferably has an elastic band interior of the portion 81 thereof which defines the opening 79, and also has a snap or VELCRO type positive fastening device to secure the opening shut. The pocket also preferably has a fluted construction, illustrated generally by reference numeral 82, so that it is expandable into a relatively large volume, large enough so that it can contain a wind resistant mitts 2 (when folded or otherwise disposed in a low volume configuration), and/or a conventional anti-contact glove (as will be further described with respect to FIG. 10).

The cold weather mitten 60 also has an attachment means associated therewith for attachment to a suspension system. The attachment means preferably comprises a conventional D-ring 84 attached by a cloth loop 85 to the mitten 60 at seam 86. Note that the ring 84 is located further from the open end 65 than the center of gravity of the mitten (which will be approximately at point CG in FIG. 8) so that when the mitten 60 is suspended it will hang with the opening 66 facing substantially downwardly, as illustrated in FIG. 7.

An exemplary, desirable suspension system for the cold weather mittens 60 is illustrated in FIG. 7. The suspension system, comprises a number of cords and barrel locks (or equivalent devices) that allow the position of the mittens from the wearer's neck, and the size of the neck opening for the suspension system, to be quickly, easily, and effectively adjusted so that the cold weather gloves can always be maintained in a ready position, and will not be blown away, or otherwise lost.

Note that the cold weather mitten 60 is constructed so that it has an inward curvature—seen most clearly at the dotted lead lines to reference numerals A and B in FIG. 6—so that the mitten is in the configuration of a wearer's hand when at rest. This significantly reduces fatigue of the wearer's hands, and enhances comfort, since there is no material tending to hold the wearer's hand "straight" in a position different than the normal curved, at rest, position of a human hand.

It is also necessary for the mitt 60 to have a high enough MVT rate so that water vapor is moved outwardly through the mitten in a manner to keep the wearer's skin substantially dry. Typically the MVT rate of the mitten 60 would be at least about 500 grams per square meter per 24 hours.

The suspension mechanism is illustrated generally by reference numeral 87 in FIG. 7 and includes a first suspension cord 88, a second suspension cord 89, and first, second, and third barrel locks (or the equivalent) 90, 91, and 92, respectively. The cords may be conventional military cords, and the second barrel lock 91 can be any commercially available barrel lock, such as those sold by Plas-Tech of Denver, Colo. (e. g. see U.S. Pat. No. 4,238,605). The first and third barrel locks can be those manufactured for Kelty Pack Company and sold under the name of "Kelty Special Cord Lock." Any other barrel lock that provides an auxiliary hole for securing the second cord 89 can be used.

Clips 93, 94 are connected to the first and second free ends 95, 96, respectively, of the first cord 88, the clips 93, 94 being conventional clips for attachment to the D-rings 84. The first and second free ends 97, 98, respectively, of the second suspension cord 89 are preferably knotted (as illustrated in FIG. 7) and pass through free bottom openings in the first and third barrel locks 90, 92. The second suspension cord 89 also is knotted at a mid portion 99 thereof, and operatively passes through the second barrel lock 91. By depressing the plunger 100 of the second barrel lock 91, the wearer can adjust the position of the barrel lock 91 along the second cord 89 so that the distance between the barrel locks 90, 92 and the barrel lock 91 may be adjusted, and along with that the maximum size of the opening 101 defined by the cords 88, 89 and barrel locks 90–92.

The first suspension cord 88 is operatively received by the barrel locks 90, and by depressing the plungers 102, 103 associated with the barrel locks 90, 92, respectively, the position of the clips 94, 95 from the first and second barrel locks 90, 92 may be adjusted. At the same time the maximum size of the opening 101 is adjusted. Preferably, a looped portion 105 and knot 106 are formed in the first cord 88 between the barrel locks 90, 92, and opposite from the barrel lock 91, the second suspension cord 89 interior of the second barrel lock 91, and the first suspension cord 88 between the barrel locks 90, 92 and the knot 106, defining the adjustable size opening 101 through which the wearer may insert his head when putting on, or removing, the suspension mechanism 87.

Figure 10:
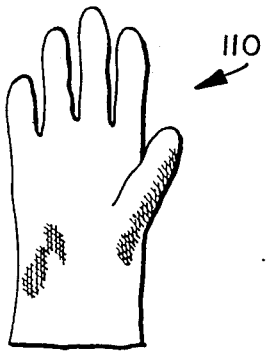
FIG. 10 is a schematic view of a conventional anti-contact glove with which the wind resistant mitten and cold weather mitten according to the invention may be utilized.

FIG. 10 illustrates a conventional anti-contact glove which desirably is utilizable with a wind resistant mitt 2 and the cold weather mitt 60 according to the invention. The anti-contact glove 110 is preferably made of 100 percent polypropylene or nylon, and allows the wearer good manual dexterity while protecting the wearer's skin from cold metal objects or the like with which it may come in contact. According to the invention, the wind resistant mitt 2 is dimensioned so that it relatively snugly fits over the anti-contact glove 110 when worn by a user, and each cold weather mitt 60 is dimensioned so that it relatively snugly fits over the wind resistant mitt 2. By merely wearing the wind resistant mitt 2 over the anti-contact glove 110, the effective temperature at which tasks requiring some manual dexterity are possible is greatly reduced (e.g. to −20 degrees F), while the cold weather mitt 60 reduces the temperature even further (e.g. to −60 degrees F).

In a normal manner of utilization of the cold weather, wind resistant equipment for protection of a human's hands according to the invention, the wearer will first put on the anti-contact gloves 110, removing them from the pockets 77 of the cold weather mittens 60. If these prove ineffective in keeping the wearer's hands warm, and the wearer must perform tasks requiring manual dexterity, the wind mitts 2 are removed from the pockets 77, while still connected to the lanyards 80 and may be detached from the lanyards 80, or while still connected to the lanyards 80, placed over the anti-contact gloves 110. Should the wearer then need further cold weather protection, the wearer can insert his hands, with wind mitts and anti-contact gloves still on, through the openings 66 in the cold weather mitts 60. Prior to putting the mittens on, the wearer can move the snap fasteners 74, 75 of each into operative association with each other to set the opening 66 to the appropriate size depending on the size of garments on his/her arms. Alternatively, the wearer can remove one or both of the wind resistant mitt 2 and the anti-contact gloves 110, and fold them or otherwise move them into a low volume configuration and stuff them into the pockets 77, while wearing the cold weather mitts 60 over a bare hand, or hand with just the anti-contact glove 110 or wind resistant mitt 2 thereon.

To prevent the cold weather mitts 60 from blowing away, or otherwise being lost—which could be a disastrous, health threatening situation—the wearer depresses plungers 100, 102, 103 as necessary to adjust the size of the opening 101, places the suspension system 87 over his head (without the necessity for removing his hood, hat, or the like), and then re-depresses the plungers 100 and/or 102, 103 to reduce the size of the opening 101 and thereby cause the suspension system 87 to more tightly hold the mittens 60 in place. Alternatively, or additionally, if it is necessary or desirable to adjust the position of the mittens 60 from the wearer's neck, the plungers 102 and/or 103 may be depressed to effect that adjustment.

It will thus be seen that according to the present invention, cold weather, wind resistant equipment for protection of a human's hands has been provided having significant advantages over the prior art. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A cold weather mitten comprising an outer synthetic material shell fabric, an inner synthetic material lining fabric, and a layer of open cell foam between said inner and outer fabrics, said layer being at least about $\frac{1}{8}$ inch thick over a majority of the mitten; said mitten having a closed finger-receiving end, with a thumb portion, and an open end, defining an opening, for insertion of the wearer's hand for positioning within the mitten; and fastening means adjacent said open end for effectively changing the size of said opening at said open end, said fastening means when in a first position providing a relatively small opening that causes the mitten to fit tightly on the wearer's forearm when the wearer has relatively thin sleeve garments on, and when in a second position providing a relatively large opening that causes the mitten to fit more loosely at the wearer's forearm to accommodate relatively thick sleeve garments and snugly engage the thick sleeves.

2. A mitten as recited in claim 1 having an inside face which includes said thumb portion, and a palm portion of said mitten; and wherein said fastening means comprise male and female snap fasteners formed on the inside face of said mitten.

3. A mitten as recited in claim 2 wherein two male fasteners and two female fasteners are provided on said inside face.

4. A mitten as recited in claim 2 having an outside face opposite a palm portion of said mitten; and further comprising a pocket, having an open end adjacent said mitten opening, and a lanyard connected to a portion of said mitten within said pocket, the lanyard having a free end extendable to a position outside said pocket.

5. A mitten as recited in claim 4 wherein said lanyard is connected to a low porosity, wind resistant mitten constructed so that it may be folded or otherwise moved into a low volume configuration and stored within said pocket; said wind resistant mitten having an air permeability of less than 15 cubic feet per minute per square foot at 0.5 inches head of water.

6. A mitten as recited in claim 5 further comprising an anti-contact glove disposed within said pocket.

7. A mitten as recited in claim 1 having an inward curvature at the hand portion thereof so that the mitten is in the configuration of a wearer's hand when at rest.

8. A mitten as recited in claim 7 further comprising a stowable trigger finger portion for receipt of the wearer's index finger, said trigger finger portion disposed between said thumb and finger-receiving portions of said mitten.

9. A mitten as recited in claim 1 further comprising a stowable trigger finger portion for receipt of the wearer's index finger, said trigger finger portion disposed between said thumb and finger-receiving portions of said mitten.

10. A mitten as recited in claim 1 further comprising an attachment means for attaching said mitten to a lanyard or the like, said attachment means located further from said open end of said mitten than the center of gravity of said mitten so that when the mitten is suspended by a lanyard or the like attached to said attachment means, said open end of said mitten faces substantially downwardly.

11. A mitten as recited in claim 1 wherein said shell fabric comprises a woven polyamide fabric treated with a water repellant coating.

12. A mitten as recited in claim 1 having a high enough MVT rate that water vapor is moved outwardly through the mitten in a manner to keep the wearer's skin substantially dry.

13. A mitten as recited in claim 1 further comprising synthetic material rib trim surrounding said opening and connecting said inner and outer fabrics together.

14. Cold weather, wind resistant equipment for protection of a human's hands, comprising:

a pair of anti-contact gloves of 100% synthetic material;

a pair of thin fabric mittens made of a low porosity wind resistant fabric, and dimensioned so that they relatively snugly fit over the anti-contact gloves when worn by a user; and a pair of cold weather mittens having an outer shell fabric of synthetic material, an inner lining fabric of synthetic material, and an open cell foam layer disposed between said inner and outer fabrics; said cold weather mittens having an open end defining an opening, for insertion of a wearer's hand into a mitten through said opening; and said cold weather mittens dimensioned so that they relatively snugly fit over the thin fabric mittens.

15. Equipment as recited in claim 14 wherein the air permeability of said low porosity wind resistant fabric is less than 15 cubic feet per minute per square foot at 0.5 inches head of water, while having an MVT rate of greater than about 500 grams per square meter per 24 hours, and wherein said open cell foam is at least about ¼ inch thick over the majority of the mitten.

16. Equipment as recited in claim 14 further comprising a pocket disposed on the outside of said cold weather mitten and opening in the same dimension as said cold weather mitten opening; each said pocket dimensioned so as to receive a said thin fabric mitten therein when said thin fabric mitten is folded or otherwise moved into a low volume configuration.

17. Equipment as recited in claim 16 further comprising a lanyard connected to a portion of each said cold weather mitten within said pocket, and having a free end extendable outwardly from the pocket and connected by a releasable fastener to a said thin fabric mitten.

18. Equipment as recited in claim 17 wherein said pocket is further dimensioned so as to receive an anti-contact glove therein in addition to a said thin fabric mitten.

19. Equipment as recited in claim 14 further comprising attachment means associated with each said cold weather mitten and located further from the open end of said mitten than the center of gravity of the mitten so that said mittens, when suspended, hang with said openings facing substantially downwardly; and a suspension mechanism for suspending said cold weather mittens, when not in use, from the wearer's neck, said suspension mechanism including:

first and second suspension cords, said first cord having first and second free ends, and said second suspension cord having first and second free ends;

first, second, and third barrel locks;

clips connected to first and second free ends of said first suspension cord for connection to said attachment means;

said first and second free ends of said second suspension cord connected to said first and third barrel locks, and said second suspension cord operatively received by said second barrel lock so that the distance between said second barrel lock and said first and third barrel locks may be adjusted; and said first suspension cord being operatively received by said first and third barrel locks, so that the position of said clips from said first and third barrel locks may be adjusted.

20. Equipment as recited in claim 19 wherein a knot is formed in said first suspension cord between said first and third barrel locks, and opposite from said second barrel lock, said second suspension cord and said first suspension cord between said first and second barrel locks defining an adjustable size opening for placement of said suspension mechanism over the head of a wearer.

21. A wind resistant mitten formed of thin fabric and comprising:

a main body portion for enclosing four fingers of a wear's hand and including a palm portion;

a thumb enclosing portion and a palm portion;

an optionally deployable third, single finger enclosing portion, the base of which extends from said main body portion; and said main body portion with the exception of the palm portion having an exterior shell constructed of a low porosity, wind resistant fabric, said palm portion substantially constructed of a durable, wear resistant fabric joined to said main body portion at least at a point coinciding with the base of said third finger portion.

22. A mitten as defined in claim 21, wherein said palm portion is joined to said main body portion along seam lines, at least one of which extends across the main body portion along a line generally corresponding to the juncture of the wearer's fingers and palm; and wherein a slit is provided in said at least one seam line for permitting said third finger portion to be moved between a first useable orientation interiorly of the main body portion, and a second useable orientation exteriorly of the main body portion.

23. A mitten as defined in claim 21, wherein said mitten further comprises a gauntlet portion extending rearwardly away from the wearer's hand to enclose at least a portion of the wearer's forearm; and wherein said gauntlet portion is integrally formed with said main body portion, and an adjustable strap is provided, encircling the mitten.

24. A mitten as defined in claim 23 wherein said adjustable strap includes hook and loop fastening means permitting said strap to be tightened as desired.

25. A mitten as recited in claim 21 wherein said low porosity, wind resistant fabric has an air permeability of less than 15 cubic feet per minute per square foot at 0.5 inches head of water, while having an MVT rate of greater than about 500 grams per square meter per 24 hours.

26. A wind resistant mitten constructed predominately of a low porosity, wind resistant fabric comprising a main body portion including a palm portion which defines a single pocket for enclosing the fingers of a wearer; a thumb enclosing portion joined to said palm portion for enclosing the thumb of the wearer, and an additional finger portion movable between a first operative position within the interior of the main body portion of the mitten, to a second operative position exteriorly of the main body portion of the mitten.

27. A suspension mechanism for suspending cold weather mittens having attachment means associated therewith when not in use, from the wearer's neck, said suspension mechanism including:

first and second suspension cords, said first cord having first and second free ends, and said second suspension cord having first and second free ends;

first, second, and third barrel locks;

clips connected to first and second free ends of said first suspension cord for clipping onto mitten attachment means;

said first and second free ends of said second suspension cord connected to said first and third barrel locks, and said second suspension cord operatively received by said second barrel lock so that the distance between said second barrel lock and said first and third barrel locks may be adjusted; and said first suspension cord being operatively received by said first and third barrel locks, so that the position of said clips from said first and third barrel locks may be adjusted.

28. Equipment as recited in claim 27 wherein a knot is formed in said first suspension cord between said first and third barrel locks, and opposite said said second barrel lock, said second suspension cord and said first suspension cord between said first and second barrel locks defining an adjustable size opening for placement of said suspension mechanism over the head of a wearer.

29. A wind resistant mitten comprising a body portion formed primarily of a thin fabric having an air permeability of less than 15 $ft.^3/min./ft.^2$ at 0.5 inches head of water, and an MVT rate of greater than about 500 $grams/in.^2/24$ hours.

30. A cold weather mitten comprising an outer synthetic material shell fabric, an inner synthetic material lining fabric, and a layer of open cell foam between said inner and outer fabrics, said layer being at least about $\frac{1}{8}$ inch thick over a majority of the mitten; said mitten having a closed finger-receiving end, with a thumb portion, and an open end, defining an opening, for insertion of the wearer's hand for positioning within the mitten; and the hand portion thereof being curved so that the mitten is in the natural configuration of a wearer's hand when at rest.

31. A mitten as recited in claim 30 having an outside face opposite a plam portion of said mitten; and further comprising a pocket, having an open end adjacent said mitten opening, and a lanyard connected to a portion of said mitten within said pocket, the lanyard having a free end extendable to a position outside said pocket.

32. A mitten as recited in claim 31 wherein said lanyard is connected to a low porosity, wind resistant mitten constructed so that it may be folded or otherwise moved into a low volume configuration and stored within said pocket; said wind resistant mitten having an air permeability of less than 15 cubic feet per minute per square foot at 0.5 inches head of water.

33. A mitten as recited in claim 30 wherein said foam layer is at least about $\frac{1}{4}$ inch thick.

34. A mitten as recited in claim 33 wherein said foam layer is between about $\frac{1}{2}$–1 inch thick.

* * * * *

UNITED STATES PATENT AND TRADEMARK OFFICE

CERTIFICATE OF CORRECTION

PATENT NO. : 4,742,580

DATED : May 10, 1988

INVENTOR(S) : Phillips, James G. and Harlow, Joanne

It is certified that error appears in the above-identified patent and that said Letters Patent is hereby corrected as shown below:

Column 3, line 39, "Verstech" should read --Versatech--; line 44, delete "of" at the end of the line. Column 4, line 21, "extend" should read --extends--; line 63, " "SCOTCHCARD" " should read --"SCOTCHGARD"--. Column 5, line 29, "lay" should read --lie--. Column 6, line 20, "mitts" should read --mitt--. Column 7, line 60, delete "while still connected to the lanyards 80". Column 9, line 67, "dimension" should read --direction--. Column 12, line 19, "500 grams/in.$^2$/24 hours" should read --500 grams/m$^2$/24 hours--; and line 32, "plam" should read --palm--.

Signed and Sealed this

Twenty-seventh Day of September, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,742,580

DATED : May 10, 1988

INVENTOR(S) : PHILLIPS et al.

It is certified that error appears in the above-identified patent and that said Letters Patent is hereby corrected as shown below:

Column 5, line 3, "tightly knit" should read --tight--.

Signed and Sealed this

Nineteenth Day of June, 1990

*Attest:*

HARRY F. MANBECK, JR.

*Attesting Officer*

*Commissioner of Patents and Trademarks*